US005980014A

United States Patent [19]

Kagami

[11] Patent Number: 5,980,014

[45] Date of Patent: Nov. 9, 1999

[54] PRINT HEAD PROVIDING CONTROLLED MIXING OF INK AND DILUENT ON THE SURFACE OF THE PRINT HEAD PRIOR TO EJECTMENT

[75] Inventor: Toshiki Kagami, Tokyo, Japan

[73] Assignee: Sony Corporation, Tokyo, Japan

[21] Appl. No.: 08/576,061

[22] Filed: Dec. 21, 1995

[30] Foreign Application Priority Data

Dec. 28, 1994 [JP] Japan ..... 6-328380

[51] Int. Cl.[6] ..... B41J 2/01

[52] U.S. Cl. ..... 347/15; 347/84

[58] Field of Search ..... 347/15, 68, 85, 347/98, 7, 11, 84

[56] References Cited

FOREIGN PATENT DOCUMENTS 4-329151 11/1992 Japan ..... 347/68

*Primary Examiner*—Benjamin R. Fuller
*Assistant Examiner*—Craig A. Hallacher
*Attorney, Agent, or Firm*—Hill & Simpson

[57] ABSTRACT

The present invention provides a print head capable of ejecting a fluid, containing at least ink, toward a printing medium for printing. The print head has an ink chamber for receiving the ink, a diluent chamber for receiving a diluent for diluting the ink, an ink orifice fluidly connected with the ink chamber for ejecting or oozing out a predetermined quantity of the ink, and a diluent orifice fluidly connected with the diluent chamber for ejecting or oozing out a predetermined quantity of diluent. The ink chamber and the diluent chamber are provided separately from each other and the ink orifice and diluent orifice are provided separately from each other. In addition, the present invention provides a process for making a print on a printing medium by using an ink ejected from a print head, the print head has an ink chamber and a diluent chamber. The process includes the steps of providing a pair of pressure-applying elements at positions corresponding to the ink chamber and the diluent chamber, impressing a quantity-determinative pulse to the pressure-applying element disposed at a position corresponding to the ink chamber, and impressing an ejecting pulse to the pressure-applying element disposed at a position corresponding to the diluent chamber.

6 Claims, 6 Drawing Sheets

PRINT HEAD PROVIDING CONTROLLED MIXING OF INK AND DILUENT ON THE SURFACE OF THE PRINT HEAD PRIOR TO EJECTMENT

BACKGROUND OF THE INVENTION

1. Field of the Invention

This invention relates to a print head for an on-demand type ink jet printer in which the printing on a printing medium is made by ejecting a fluid containing at least an ink, and a process of making the printing on a printing medium by using the print head, and more particularly to an improvement in a tone gradation of an ink concentration of the print images in dot matrix-printing region.

2. Related Art

Color printing has been hitherto carried out by various methods such as an ink jet printing method, a heat-fusion type image-transferring method, a heat-sublimation type image-transferring method, an electrostatic printing method or the like. Among them, the ink jet printing method has excellent features that it can exhibit a high resolution and is capable of expressing mat-glazed images and gentle colors. Further, the ink jet printing method can provide a relatively low running cost and enables the printing on a large-size paper. Consequently, the ink jet printing method is predominately used in the production of large-size posters or monitoring prints in the fields of apparel-relating or interior-relating industries. Since the mat-glazed color tone obtained by the ink jet printing method is suitable to express an excellent texture sense of cloths, there has been particularly an increased demand therefor in the apparel-relating industry.

OBJECT AND SUMMARY OF THE INVENTION

In U.S. Pat. No. 5,371,529 and the copending U.S. patent application Ser. No. 346,162 both owned by the same assignee as the present application, there is disclosed a print head for use in an ink jet printer of a two-component type, in which ink droplets ejected are formed by mixing an ink and a diluent together and which comprises a print head base formed with the respective chambers for storing the ink and the diluent and piezo-electric elements mounted on the print head base to thereby form ink droplets to be ejected toward a printing medium.

In the print head used in the ink jet printer of the two-component type as mentioned above, the mixing of the ink and the diluent is performed by impressing a quantity-determinative pulse to one of the piezo-electric elements and then the ink droplets are ejected from the print head by impressing an ejection pulse to the other of the piezo-electric elements. As a result, the ink droplets which are a mixture of the ink and the diluent are directed toward the printing medium in the form of a spray of fine particles.

Meanwhile, the previously proposed print head used in the ink jet printer of the two-component type has such a construction that an ink passage for feeding the ink is opened into a diluent passage for feeding the diluent, in a branched manner.

It is therefore an object of the present invention to provide a print head for use in an on-demand type ink jet printer in which a dynamic range of concentration of ink droplets ejected and a tone gradation obtained thereby is highly improved, and it is another object to provide a printing process using the print head.

The print head according to the present invention is concerned with those used in an ink jet printer of a so-called two-component type in which a fluid containing at least an ink is ejected toward a printing medium, particularly the fluid is composed of a mixture of the ink and the diluent.

In accordance with one aspect of the present invention, there is provided a print head which comprises an ink chambers receiving an ink, a diluent chamber for receiving a diluent for the ink, an ink orifice fluidly communicated with the ink chamber and serving for ejecting the ink or oozing out a predetermined quantity of the ink, and a diluent orifice fluidly communicated with the diluent chamber and serving for ejecting the diluent or oozing out a predetermined quantity of the diluent, wherein the ink chamber and the diluent chamber are provided separately from each other as well as the ink orifice and the diluent orifice whereby expressions or representability for highlighted portions or high density portions of print images are greatly improved so that a high tone gradation of the printed images can be obtained.

In one preferred form, the print head further comprises a pair of pressure-applying means which are disposed at positions corresponding to the ink chamber and the diluent chamber for ejecting the ink or the diluent from the print head or oozing out a predetermined quantity of the ink or the diluent therefrom upon impression of an ejection pulse or a quantity-determinative pulse. The pressure-applying means may include, for example, piezo-electric elements or heater elements.

In a further preferred form of the print head according to the present invention, the ink chamber and the ink orifice are disposed in a line-symmetric relation to the diluent chamber and the diluent orifice, respectively.

In a further aspect of the present invention, there is provided a printing process using the print head which comprises the steps of providing a pair of pressure-applying means at positions corresponding to an ink chamber and a diluent chamber, respectively, impressing a quantity-determinative pulse to one of the pressure-applying means disposed at the position corresponding to the ink chamber, and impressing an ejection pulse to the other of the pressure-applying means disposed at the position corresponding to the diluent chamber.

In a still further aspect of the present invention, there is provided a printing process using the print head which comprises the steps of providing a pair of pressure-applying means at positions corresponding to an ink chamber and a diluent chamber, respectively, impressing a quantity-determinative pulse to one of the pressure-applying means disposed at the position corresponding to the diluent chamber, and impressing an ejection pulse to the other of the pressure-applying means disposed at the position corresponding to the ink chamber.

As mentioned above, in the print head according to the present invention, the ink chamber and the diluent chamber are provided separately from each other as well as the ink orifice and the diluent orifice, and a pair of the pressure-applying means are disposed at the positions corresponding to the ink chamber and the diluent chamber. As a result, the print head can have such a construction that one of the two pressure-applying means is impressed with the quantity-determinative pulse while the other of the two pressure-applying means is impressed with the ejection pulse. Consequently, the ink and the diluent can be selectively used as a primary fluid for the ink droplets ejected and a mixing ratio of the ink to the diluent can be optionally adjusted, so that excellent expressions or representability for the highlighted portions or the high density portions of the print images can be obtained. This leads to widening a dynamic range of concentration of the ink droplets ejected and at the same time achieving a high tone gradation of the print images.

Namely, when a quantity-determinative pulse is impressed to the pressure-applying means disposed at the position corresponding to the ink chamber, the ink in the ink chamber is permitted to ooze out through the ink orifice. Successively, when an ejection pulse is impressed to the pressure-applying means disposed at the position corresponding to the diluent chamber, the diluent is ejected from the diluent orifice while it is mixed with the ink already oozed out from the ink orifice. In this case, a primary fluid of ink droplets ejected from the print head is the diluent.

On the other hand, when a quantity-determinative pulse is impressed to the pressure-applying means disposed at the position corresponding to the diluent chamber, the diluent in the diluent chamber is permitted to ooze out through the diluent orifice. Successively, when an ejection pulse is impressed to the pressure-applying means disposed at the position corresponding to the ink chamber, the ink is ejected from the ink orifice while it is mixed with the diluent already oozed out from the diluent orifice. In this case, a primary fluid of ink droplets ejected from the print head is the ink.

DETAILED DESCRIPTION OF THE INVENTION

Figure 1A:
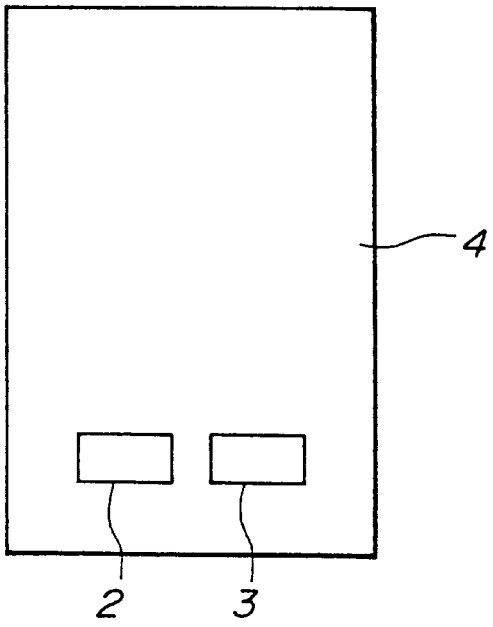
FIG. 1A is a top plan view showing a print head according to a first embodiment of the present invention.
Figure 1B:
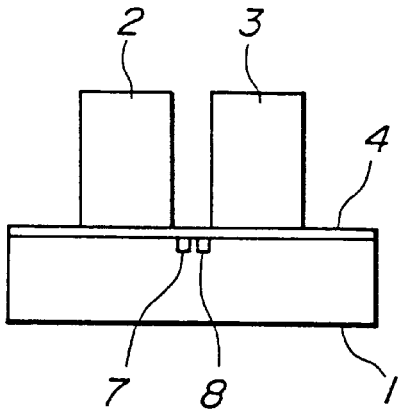
FIG. 1B is a front elevation view of the print head as shown in FIG. 1A.
Figure 1C:
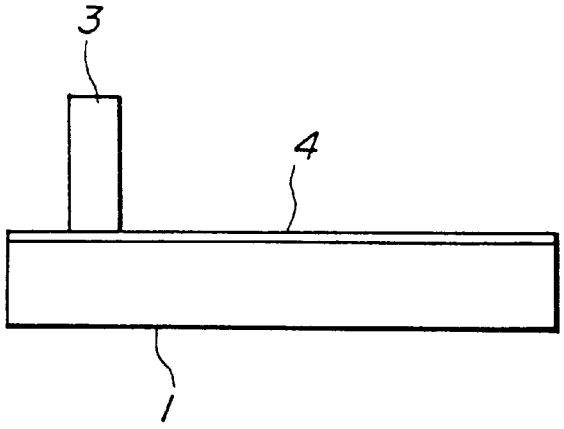
FIG. 1C is a side view of the print head as shown in FIG. 1A.
Figure 2C:
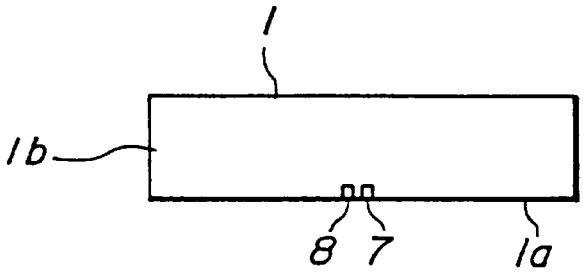
FIG. 2C is a front view of the print head base of FIG. 2A.
Figure 2B:
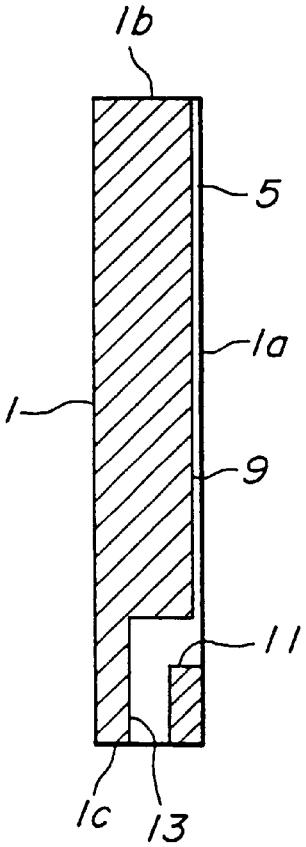
FIG. 2B is a sectional view of the print head base taken along the line A—A of FIG. 2A.
Figure 2A:
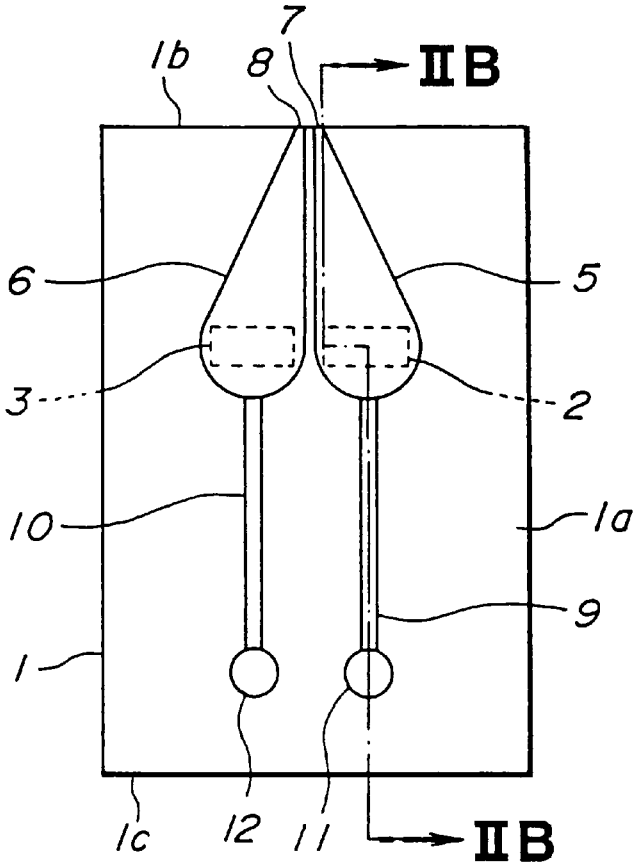
FIG. 2A plan view showing a print head base of the print head according to the first embodiment of the present invention.
Figure 2D:
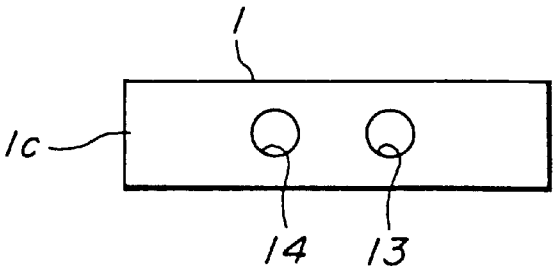
FIG. 2D is a rear view of the print head base of FIG. 2A.

Referring now to FIGS. 1A through 1C, there is shown a print head according to a preferred embodiment of the present invention, which comprises a print head base 1, a pressure-applying means composed of a pair of piezo-electric elements 2 and 3 and a vibration plate (diaphragm) 4.

The print head base 1 may be made of stainless steel such as, for example, SUS-303 steel and be of a rectangular shape.

As shown in FIGS. 2A through 2D, the print head base 1 has a primary surface 1*a* on which there are separately formed an ink chamber 5 for storing an ink and a diluent chamber 6 for storing a diluent.

Each of the ink chamber 5 and the diluent chamber 6 is formed into a recess having an approximately triangular shape when seen in the plan view such that a width thereof gradually increases in a longitudinal direction of the print head base 1 from one end surface 1*b* toward the other end surface 1*c*. The ink chamber 5 and the diluent chamber 6 both can be formed by recessing the primary surface 1*a* in the depth direction, using machining techniques such as an end mill-machining or etching techniques.

The ink chamber 5 and the diluent chamber 6 are opened to the end surface 1*b* of the print head base 1 through an ink orifice 7 and a diluent orifice 8, respectively. This construction enables the ink stored in the ink chamber 5 and the diluent stored in the diluent chamber 6 to be ejected through the ink orifice 7 and through the diluent orifice 8, respectively.

Portions of both the ink and the diluent exposed to the orifices 7 and 8 have a tendency to be swelled outwardly into a spherical drop shape due to a surface tension thereof. Consequently, it is suitable that the ink orifice 7 and the diluent orifice 8 may be in the form of either circular or rectangular outlet opening. In the preferred embodiment illustrated in the figures, the orifices 7 and 8 are formed into a rectangular opening having a size of 50 $\mu$m×25 $\mu$m.

Further, a capillary ink passage 9 and a capillary diluent passage 10 are also recessed on the primary surface 1*a* of the print head base 1. Each of the capillary ink passage 9 and the capillary diluent passage 10 are in the form of a narrow straight groove extending on the primary surface 1*a* of the print head base 1 in the longitudinal direction thereof, and connected at one end thereof with the ink chamber 5 or the diluent chamber 6. The other end of each of the capillary ink passage 9 and the capillary diluent passage 10 is connected to outlet bores 11 or 12.

The outlet bores 11 and 12 are recessed in the form of a blind hole having a circular shape in section and extend from the primary surface 1*a* in the direction of the thickness of the print head base 1. The outlet bores 11 and 12 are communicated at a bottom thereof with inlet bores 13 and 14 opened to the rear end surface 1*c*, respectively.

Accordingly, the ink and the diluent, which are supplied from respective fluid sources (not shown) into the inlet bores 13 and 14, are flown through the outlet bores 11 and 12 toward the primary surface 1*a* and then through the capillary passages 9 and 10 into the ink chamber 5 and the diluent chamber 6, respectively.

Meanwhile, the ink chamber 5, the ink orifice 7, the capillary ink passage 9 and the outlet bore 11 are disposed in a line-symmetric relation to the diluent chamber 6, the diluent orifice 8, the capillary diluent passage 10 and the outlet bore 12, respectively. Particularly, the ink orifice 7 for the ink and the diluent orifice 8 for the diluent are located closely adjacent to each other.

On the other hand, the vibration plate 4 is fixedly mounted on the primary surface 1*a* of the print head base 1 in a close contact manner. The vibration plate 4 functions to transmit the an oscillation force generated from a pair of the piezo-electric elements 2 and 3 to the ink in the ink chamber 5 and the diluent in the diluent chamber 6, respectively, and prevent leakage of the ink and the diluent from the ink chamber 5 and the diluent chamber 6, respectively. Such a vibration plate 4 may be a glass plate made of borosilicate glass and having a thickness of 160 μm and a size almost similar,to an area of the primary surface 1*a* of the print head base 1.

In the preferred embodiment of the present invention, a dry film type resist material is provided between the primary surface 1*a* of the print head base 1 and the vibration plate 4 and adhered thereto by heating it by a light exposure. In the actual production procedure of the print head according to the preferred embodiment of the present invention, the dry film type resist material (Trade name: SG-2300G manufactured by Hitachi Kasei K.K.) having a thickness of 50 μm was placed between the primary surface 1*a* of the print head base 1 and the vibration plate 4 and exposed to an irradiated light for 1 minute to heat the resist material to 150° C. A thickness of the dry film type resist material is preferably 50 μm or less, for example 15 μm.

The print head base 1 and the vibration plate 4 may be made of any material exhibiting a sufficient rigidity, and further a high water-resistance in the case of using an aqueous fluid in the print head or a high oil-resistance in the case of using an oily fluid in the print head.

The piezo-electric elements 2 and 3 function to determine a quantity of the ink or the diluent oozed from the orifice or eject the ink or the diluent to form ink droplets directed toward the printing medium when the respective pulses are impressed thereon. The piezo-electric elements 2 and 3 are disposed on the vibration plate 4 at the positions corresponding to the ink chamber 5 and the diluent chamber 6, respectively. The piezo-electric elements 2 and 3 are impressed with a pulse for the quantitative determination or a pulse for the ejection on the basis of input printing data. Consequently, either the ink or the diluent can be selectively ejected as a primary fluid from the print head.

Figure 3A:
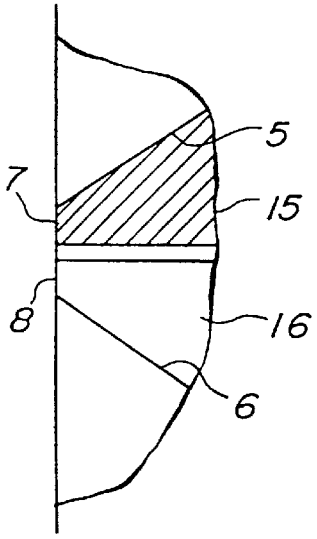
FIGS. 3A to 3C are fragmentary enlarged views of orifice portions of the print head according to the present invention, showing a series of ejection steps in which a diluent is used as a primary fluid of ink droplets ejected.
Figure 3B:
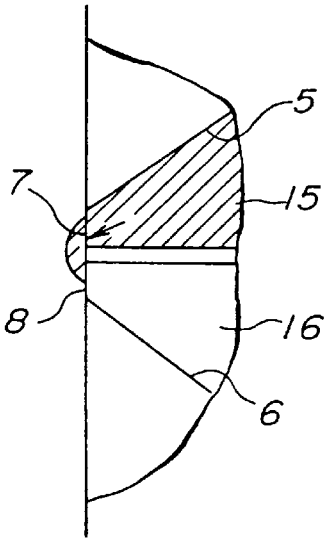
Figure 3C:
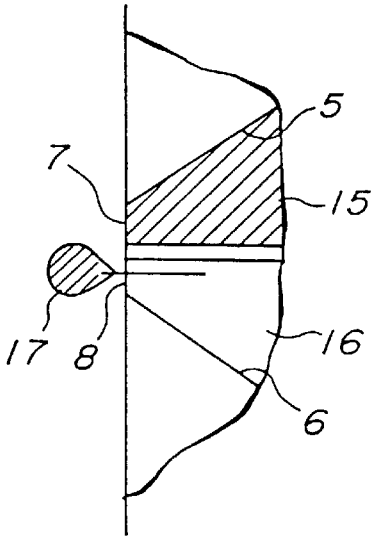
Figures 5A, 5B:
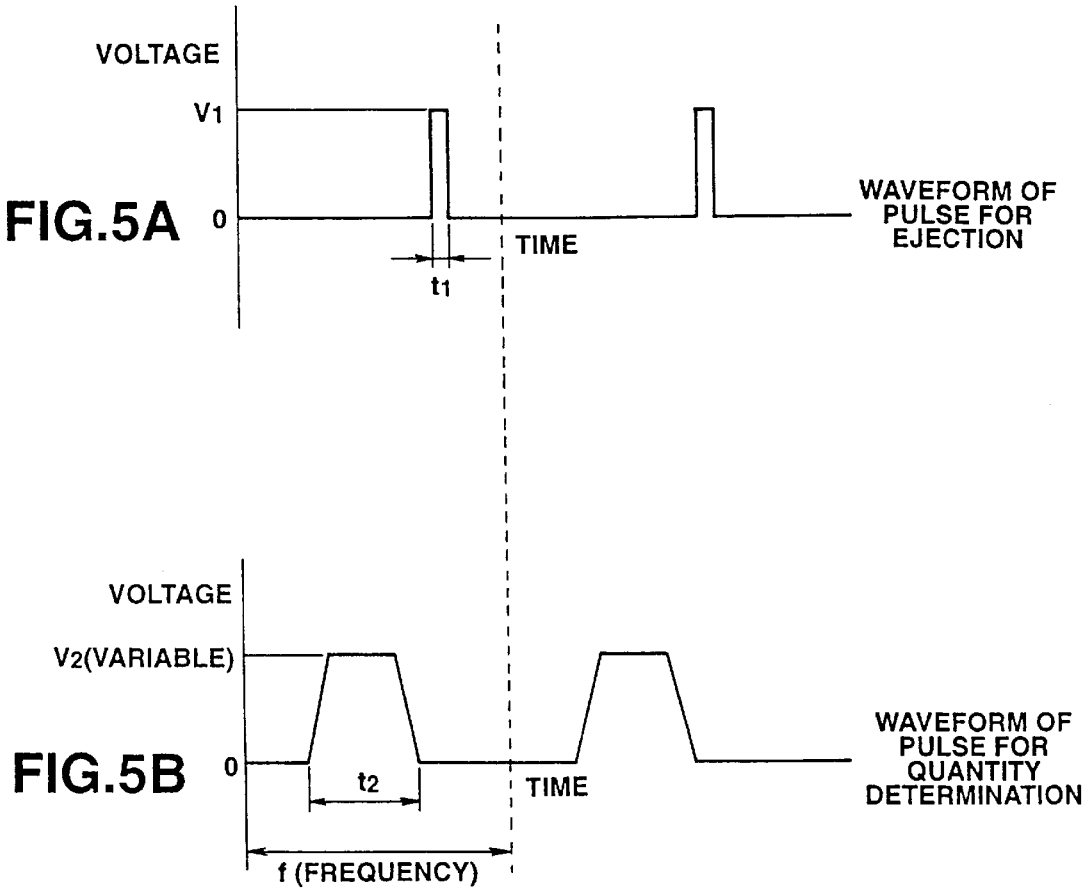
FIG. 5A is a graph showing a wave form of an ejection pulse impressed on a piezo-electric element.
FIG. 5B is a graph showing a wave form of a quantity-determinative pulse impressed to a piezo-electric element.

For example, when the diluent is intended to be ejected as a primary fluid from the print head, the quantity-determinative pulse having an approximately trapezoid as shown in FIG. 5*b* is impressed to the piezo-electric element 2 disposed at the position corresponding to the ink chamber 5 so that a predetermined quantity of the ink 15 is oozed out from the ink orifice 7 as shown in FIGS. 3A through 3C. Successively, an ejection pulse having a rectangular shape as shown in FIG. 5*a* is impressed to the piezo-electric element 3 disposed at the position corresponding to the diluent chamber 6. As a result, the portion of the ink 15 oozed from the ink orifice 7 is mixed with a portion of the diluent 16 expelled from the diluent orifice 8 so that a series of ink droplets 17 serving for printing are ejected from the print head.

Figure 4A:
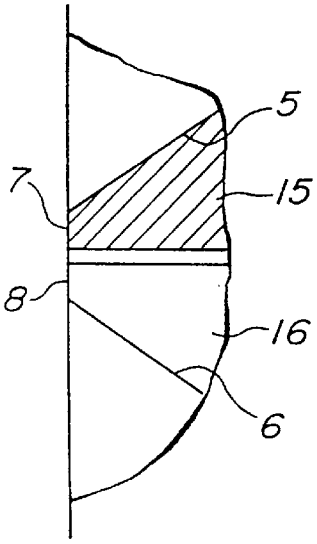
FIGS. 4A to 4C are fragmentary enlarged views of orifice portions of the print head according to the present invention, showing a series of ejection steps in which an ink is used as a primary fluid of ink droplets ejected.
Figure 4B:
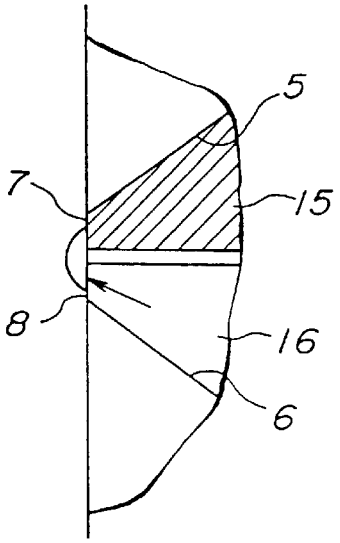
Figure 4C:
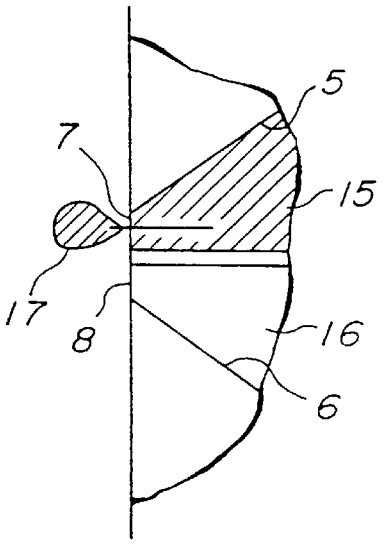

On the other hand, when it is intended that the ink is elected as a primary fluid from the print head, the quantity-determinative pulse is impressed to the piezo-electric element 3 disposed at the position corresponding to the diluent chamber 6 so that a predetermined quantity of the diluent 16 is oozed out from the diluent orifice 8 as shown in FIGS. 4A through 4C. Successively, the ejection pulse is impressed to the piezo-electric element 2 disposed at the position corresponding to the ink chamber 5. As a result, the portion of the diluent 16 oozed from the orifice 8 is mixed with the portion of the ink 15 expelled from the ink orifice 7 so that a series of ink droplets 17 are ejected from the print head.

Thus, in the case where the diluent 16 is ejected as a primary fluid of the ink droplets 17 from the print head, a print result can be obtained with excellent highlighted portions. On the other hand, in the case where the ink 15 is ejected as a primary fluid from the print head, a print result can be obtained with excellent high-density portions. Further, when no pulse is impressed to the piezo-electric element 3 for the diluent 16 in the diluent chamber and therefore only the ink 15 is ejected from the print head, a print image having a highest density can be obtained. Accordingly, a wide dynamic range of the ink density and at the same time a high tone gradation is producible by appropriately varying a proportion of the diluent 16 to the ink 15 in the ink droplets 17 ejected from the print head.

Meanwhile, the ink 15 usable in the present invention has, for example, a composition as shown in Table 1 below. On the other hand, the diluent 16 usable in the present invention may be a transparent solvent, particularly water.

TABLE 1

| Ink Composition | Amount |
|---|---|
| Dye (C.I. Basic Red 46) | 2 wt %* |
| Glycerin | 2 wt %* |
| Diethylene-glycol | 6 wt %* |
| Water | 90 wt %* |

Note: The "wt %" indicated by asterisk represents "per cent by weight."

Figures 6A, 6B:
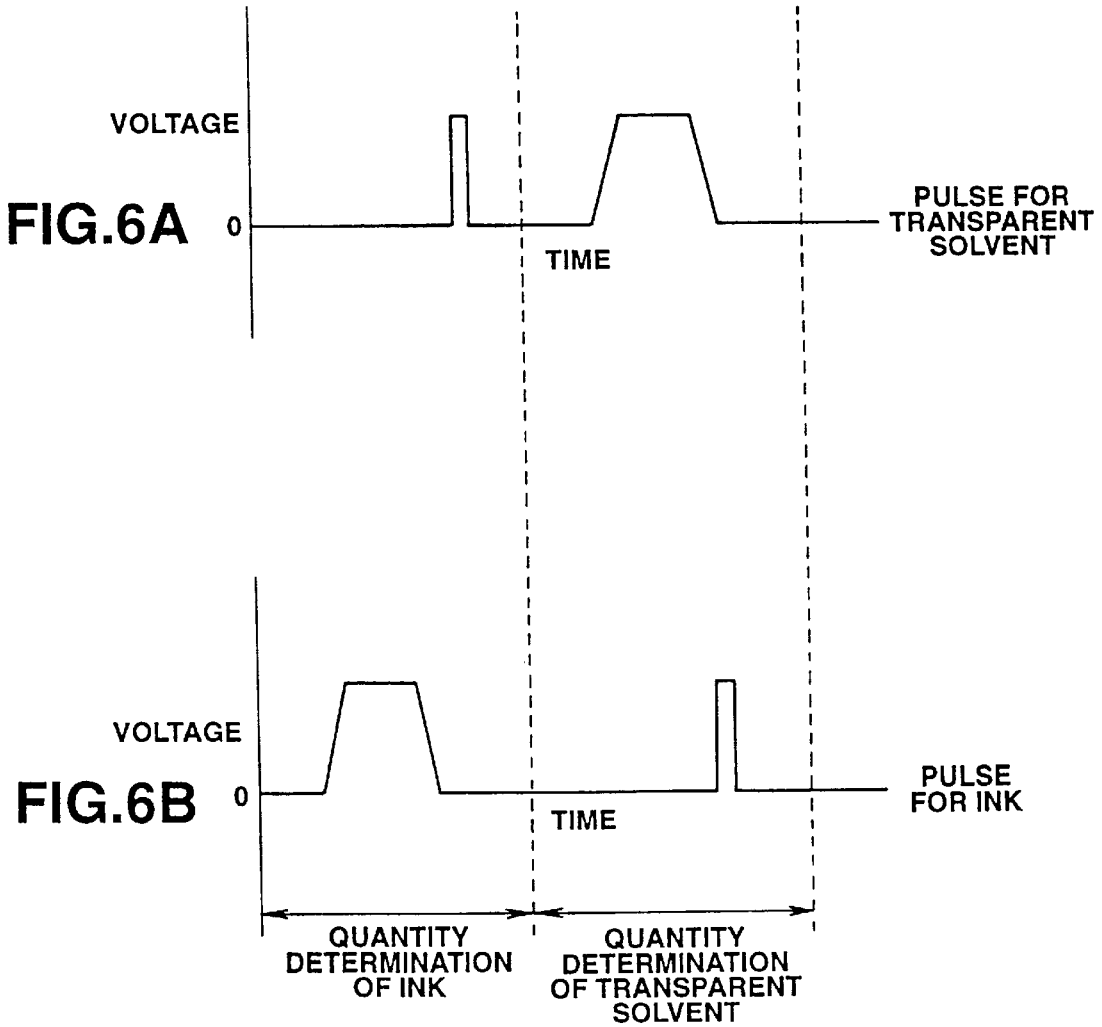
FIG. 6A is a graph showing a timing relation between an ejection pulse and a quantity-determinative pulse for a transparent solvent (diluent) and FIG. 6B is a graph showing a timing relation between a quantity-determinative pulse and an ejection pulse for an ink.

The impression of the pulses on the respective piezo-electric elements 2 and 3 is conducted at a frequency of 300 Hz, a voltage of 20 V (0.1 ms) for the quantity-determinative pulse and 15 V (0.05 ms) for the ejection pulse. Further, an impression timing interval between the quantity-determinative pulse and the ejection pulse is set to 1 ms. The impression timing intervals between the quantity-determinative pulse and the ejection pulse are shown in FIGS. 6A and 6B.

Figure 7A:
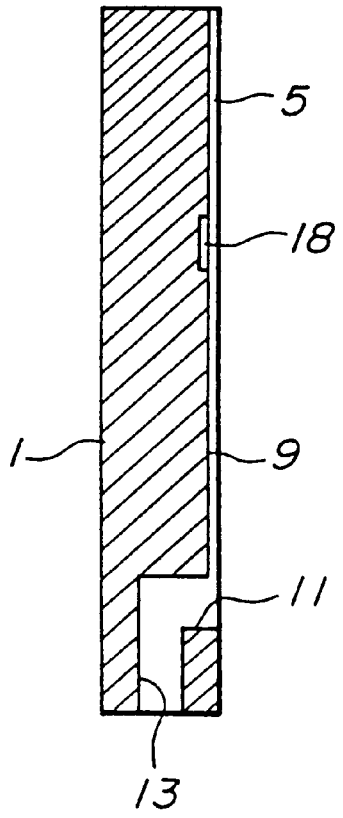
FIG. 7A is a print head base of a print head according to a second embodiment of the present invention in which heater elements are employed as pressure-applying means.
Figure 7B:
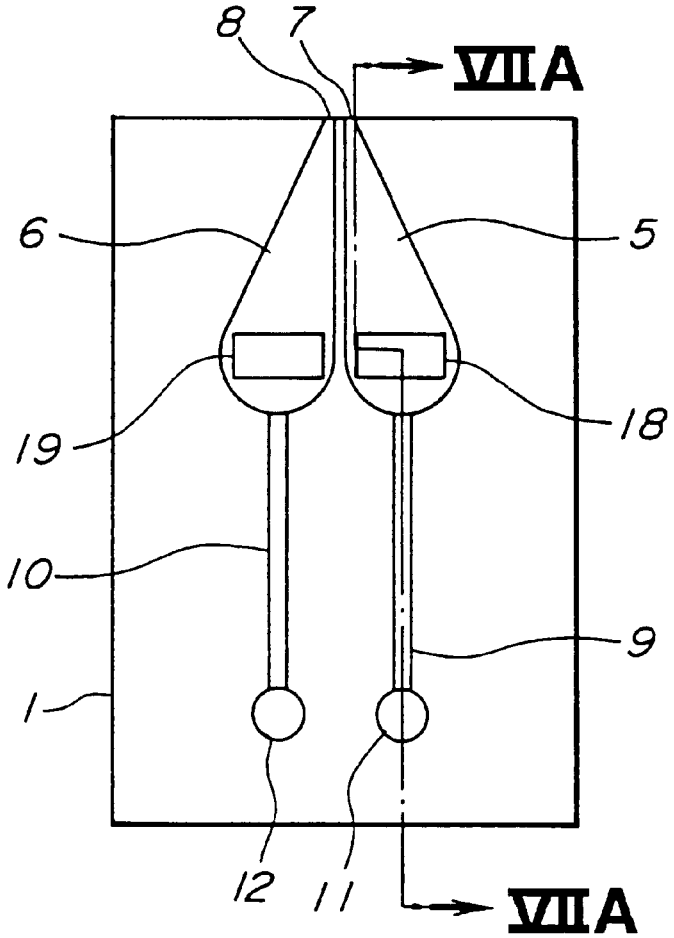
FIG. 7B is a sectional view of the print head base taken along the line B—B of FIG. 7A.

While the preferred embodiment of the present invention is described hereinbefore, it is to be understood that the present invention is not limited to this particular form of apparatus, and modifications and changes may be made without departing from the scope of the invention. For example, heater elements may be used to achieve similar functions or effects instead of the piezo-electric elements 2 and 3 used in the above preferred embodiment of the present invention. Another embodiment of the present invention in which the heater elements 18 and 19 are used instead of the piezo-electric elements 2 and 3 is illustrated in FIG. 7. In this embodiment, the heater element 18 or 19 may be disposed in a recess formed at a bottom surface of the ink chamber 5 or the diluent chamber 6, or otherwise directly adhered to the bottom surface of the ink chamber 5 or the diluent chamber 6. Meanwhile, when the heater elements 18 and 19 are employed as the pressure-applying means, a glass plate may be used instead of the vibration plate 4. As will apparently understood, the glass plate does not function as the vibration-causing plate but serves only for preventing a leakage of the fluids in the ink chamber 5 or the diluent chamber 6.

In the embodiments mentioned above, the ink chamber 5 or the diluent chamber 6 are provided in the print head base 1. However, the ink chamber 5 and the diluent chamber 6 may be formed in an adhesive layer which is interposed between the print head base 1 and the vibration plate 4. In this case, the print head base 1 serves as a supporting member only.

As mentioned above, in accordance with the present invention, since the ink chamber and the diluent chamber are provided separately from each other as well as the ink orifice and the diluent orifice and the respective pressure-applying means are disposed at positions corresponding to the ink chamber and the diluent chamber, a mixing ratio of the ink to the diluent can be adjusted optionally and indefinitely so that the dynamic range of the concentration of the ejected ink droplets is considerably widened. Further, expressions or representability for the highlighted portions or the high-density portions of the print image is highly improved so that a excellent tone gradation thereof can be obtained.

In addition, in accordance with the printing process of the present invention, since either of the ink or the diluent can be used as a primary fluid of the ink droplets to be ejected toward a printing medium, further improvement in the expressions or representability for the highlighted portions or the high-density portions of the print image can be achieved.

What is claimed is:

1. A print head capable of ejecting a fluid containing at least an ink toward a printing medium for printing, comprising:

a print head body having a surface;

an ink chamber for receiving said ink defined in the print head body;

a diluent chamber for receiving a diluent for said ink defined in said print head body;

an ink orifice defined in said surface fluidly communicating with said ink chamber and serving for ejecting said ink or oozing out a predetermined quantity of the ink on the surface; and a diluent orifice defined in the surface fluidly communicating with said diluent chamber and serving for ejecting said diluent or oozing out a predetermined quantity of the diluent on the surface, wherein said ink chamber and said diluent chamber are provided separately from each other and said ink orifice and said diluent orifice are provided separately but closely adjacent to each other so that said predetermined quantity of said ink and said predetermined quantity of said diluent mix on the surface at an end of said ink orifice and said diluent orifice when ejected from said ink orifice and said diluent orifice, respectively.

2. The print head according to claim 1, wherein said ink chamber and said ink orifice are disposed in a line-symmetric relation to said diluent chamber and said diluent orifice, respectively.

3. The print head according to claim 1, further comprising a pair of pressure-applying means disposed at positions corresponding to said ink chamber and said diluent chamber, one of said pressure-applying means being impressed by a quantity-determinative pulse and the other of said pressure-applying means being impressed by an ejection pulse.

4. The print head according to claim 1, further comprising pressure-applying means disposed at positions corresponding to said ink chamber and said diluent chamber for applying a quantity-determinative pulse to one of said ink chamber and said diluent chamber and applying an ejection pulse to the other of said ink chamber and diluent chamber to cause ejection and mixing of said predetermined quantity of ink and said predetermined quantity of diluent.

5. A process for making a print on a printing medium by using an ink ejected from a print head including an ink chamber and a diluent chamber respectively in communication with a separate ink orifice and a diluent orifice, comprising the steps of:

providing a pair of pressure-applying means at positions corresponding to said ink chamber and said diluent chamber, respectively;

impressing a quantity-determinative pulse to one of said pressure-applying means disposed at the position corresponding to said ink chamber to eject a predetermined quantity of ink from said ink orifice; and impressing an ejection pulse to the other of said pressure-applying means disposed at the position corresponding to said diluent chamber to eject a predetermined quantity of diluent from said diluent orifice to mix with said predetermined quantity of ink on an end surface of said ink orifice and said diluent orifice.

6. A process for making a print on a printing medium by using an ink ejected from a print head including an ink chamber and a diluent chamber respectively in communication with a separate ink orifice and diluent orifice, comprising the steps of:

providing a pair of pressure-applying means at positions corresponding to said ink chamber and said diluent chamber, respectively;

impressing a quantity-determinative pulse to one of said pressure-applying means disposed at the position corresponding to said diluent chamber to eject a predetermined quantity of diluent from said diluent orifice; and impressing an ejection pulse to the other of said pressure-applying means disposed at the position corresponding to said ink chamber to eject a predetermined quantity of ink from said ink orifice to mix with said predetermined quantity of diluent on an end surface of said ink orifice and said diluent orifice.

* * * * *